US012060632B2

(12) United States Patent
Nishimura et al.

(10) Patent No.: US 12,060,632 B2
(45) Date of Patent: Aug. 13, 2024

(54) FERRITIC STAINLESS STEEL SHEET

(71) Applicant: NIPPON STEEL STAINLESS STEEL CORPORATION, Tokyo (JP)

(72) Inventors: Kou Nishimura, Tokyo (JP); Yoshiharu Inoue, Tokyo (JP)

(73) Assignee: NIPPON STEEL STAINLESS STEEL CORPORATION, Tokyo (JP)

( * ) Notice: Subject to any disclaimer, the term of this patent is extended or adjusted under 35 U.S.C. 154(b) by 267 days.

(21) Appl. No.: 17/770,095

(22) PCT Filed: Nov. 17, 2020

(86) PCT No.: PCT/JP2020/042749
§ 371 (c)(1),
(2) Date: Apr. 19, 2022

(87) PCT Pub. No.: WO2021/100687
PCT Pub. Date: May 27, 2021

(65) Prior Publication Data

US 2022/0389555 A1 Dec. 8, 2022

(30) Foreign Application Priority Data

Nov. 19, 2019 (JP) ..... 2019-208646

(51) Int. Cl.
*C22C 38/60* (2006.01)
*C21D 1/06* (2006.01)
(Continued)

(52) U.S. Cl.
CPC ..... *C22C 38/60* (2013.01); *C21D 1/06* (2013.01); *C21D 6/004* (2013.01); *C21D 8/0205* (2013.01);
(Continued)

(58) Field of Classification Search
None
See application file for complete search history.

(56) References Cited

U.S. PATENT DOCUMENTS 4,464,207 A * 8/1984 Kindlimann ..... C22C 38/28 148/318
2017/0088912 A1* 3/2017 Fukuda ..... C22C 38/32
(Continued)

FOREIGN PATENT DOCUMENTS

| | | |
|---|---|---|
| EP | 2 474 635 | 7/2012 |
| EP | 2 767 603 | 8/2014 |
| JP | 2005-320559 | 11/2005 |

*Primary Examiner* — John Vincent Lawler
(74) *Attorney, Agent, or Firm* — Clark & Brody LP

(57) ABSTRACT

A ferritic stainless steel sheet includes a base metal and a nitrided layer that is formed on a surface of the base metal, a chemical composition of the base metal contains, in mass %, C: 0.001 to 0.020%, Si: 0.01 to 1.50%, Mn: 0.01 to 1.50%, P: 0.010 to 0.050%, S: 0.0001 to 0.010%, Cr: 16.0 to 25.0%, N: 0.001 to 0.030%, Ti: 0.01 to 0.30%, and optional elements, with the balance: Fe and unavoidable impurities, a steel microstructure of the base metal includes, in volume ratio, 95% or more of a ferritic phase, the nitrided layer is a layer that is present in a region from a surface of a rolled surface to a 0.05 μm depth position in a sheet thickness direction, and an average nitrogen concentration in the nitrided layer is, in mass %, 0.80% or more.

8 Claims, 1 Drawing Sheet

(51) Int. Cl.

| | |
|---|---|
| ***C21D 6/00*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C23C 8/26*** | (2006.01) |

(52) U.S. Cl.

CPC ..... *C21D 8/0226* (2013.01); *C21D 8/0236* (2013.01); *C21D 8/0263* (2013.01); *C21D 9/46* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C23C 8/26* (2013.01); *C21D 2211/005* (2013.01)

(56) References Cited

U.S. PATENT DOCUMENTS

2017/0349995 A1* 12/2017 Fukuda ..... C22C 38/001
2018/0355460 A1* 12/2018 Kong ..... C23C 8/26

* cited by examiner

FERRITIC STAINLESS STEEL SHEET

TECHNICAL FIELD

The present invention relates to a ferritic stainless steel sheet.

BACKGROUND ART

Automobile components include various types of components and members such as an exhaust manifold, a muffler, a catalyst, a flexible tube, and a center pipe. These components are repeatedly heated and cooled, and thus a ferritic stainless steel sheet, which resists thermal expansion and is suitable for heat resistant application, is used for the components.

A ferritic stainless steel sheet used for the components described above is required to have heat resistant properties and has recently been required to have, in addition to the heat resistant properties, initial corrosion resistance on an outer surface of a member. Here, initial corrosion refers to red rust that occurs on a component and a member that can be seen relatively easily, such as an exhaust manifold and a muffler, in a very short period of time from shipment of an automobile until before its use or immediately after the use. The initial corrosion has no effect on a life of a member but is not desirable in appearance. Thus, there is a demand for preventing or reducing occurrence of initial corrosion.

For example, Patent Document 1 discloses an automobile exhaust component from a steel having the same chemical composition as SUS 409L as a starting material. The automobile exhaust component is improved in resistance against initial corrosion.

Further, the automobile exhaust component is made to contain Cr, which is effective for corrosion resistance, namely initial corrosion resistance, at a content of Cr of 10.0 to 13.5%. In addition, the initial corrosion resistance is improved by forming a coating film containing silicates of alkali metals or alkaline earth metals, on a surface of the component to be exposed to an external environment.

LIST OF RELATED ART DOCUMENTS

Patent Document

Patent Document 1: JP2005-320559A

SUMMARY

Technical Problem

The ferritic stainless steel sheet disclosed in Patent Document 1 needs a coating treatment to be performed on its surface for preventing or reducing occurrence of initial corrosion. This raises a problem of increasing the number of processes and increasing production costs.

An objective of the present invention is to solve the problem and provide a ferritic stainless steel sheet for which the number of processes is reduced and that is capable of preventing or reducing initial corrosion.

Solution to Problem

The present invention is made to solve the problem described above, and the gist of the present invention is the following ferritic stainless steel sheet.

(1) A ferritic stainless steel sheet including
a base metal and a nitrided layer that is formed on a surface of the base metal, wherein
a chemical composition of the base metal consists of, in mass %
C: 0.001 to 0.020%,
Si: 0.01 to 1.50%,
Mn: 0.01 to 1.50%,
P: 0.010 to 0.050%,
S: 0.0001 to 0.010%,
Cr: 16.0 to 25.0%,
N: 0.001 to 0.030%,
Ti: 0.01 to 0.30%,
Nb: 0 to 0.80%,
Sn: 0 to 0.50%,
Al: 0 to 3.0%,
Ni: 0 to 2.0%,
V: 0 to 1.0%,
Cu: 0 to 2.0%,
Mo: 0 to 3.0%,
Ca: 0 to 0.0030%,
Ga: 0 to 0.1%,
B: 0 to 0.0050%,
W: 0 to 3.0%,
Co: 0 to 0.50%,
Sb: 0 to 0.50%,
Mg: 0 to 0.0100%,
Zr: 0 to 0.30%,
Ta: 0 to 0.10%, and
REM: 0 to 0.05%,
with the balance: Fe and unavoidable impurities,
a steel microstructure of the base metal includes, in volume ratio, 95% or more of a ferritic phase,
the nitrided layer is a layer that is present in a region from a surface of a rolled surface to a 0.05 μm depth position in a sheet thickness direction, and
an average nitrogen concentration in the nitrided layer is, in mass %, 0.80% or more.

(2) The ferritic stainless steel sheet according to (1) above, wherein a chemical composition of the base metal contains one or more elements selected from, in mass %:
Nb: 0.10 to 0.80%,
Sn: 0.01 to 0.50%,
Al: 0.003 to 3.0%,
Ni: 0.1 to 2.0%,
V: 0.05 to 1.0%,
Cu: 0.1 to 2.0%,
Mo: 0.10 to 3.0%,
Ca: 0.0001 to 0.0030%, and
Ga: 0.0002 to 0.1%.

(3) The ferritic stainless steel sheet according to (1) or (2) above, wherein a chemical composition of the base metal contains one or more elements selected from, in mass %:
B: 0.0002 to 0.0050%,
W: 0.1 to 3.0%,
Co: 0.02 to 0.50%, and
Sb: 0.01 to 0.50%.

(4) The ferritic stainless steel sheet according to any one of (1) to (3) above, wherein a chemical composition of the base metal contains one or more elements selected from, in mass %:
Mg: 0.0002 to 0.0100%,
Zr: 0.05 to 0.30%,
Ta: 0.01 to 0.10%, and
REM: 0.001 to 0.05%.

Advantageous Effects

According to the present invention, it is possible to provide a ferritic stainless steel sheet for which the number of processes can be reduced and that can prevent or reduce initial corrosion.

DESCRIPTION OF EMBODIMENTS

Figure 1:
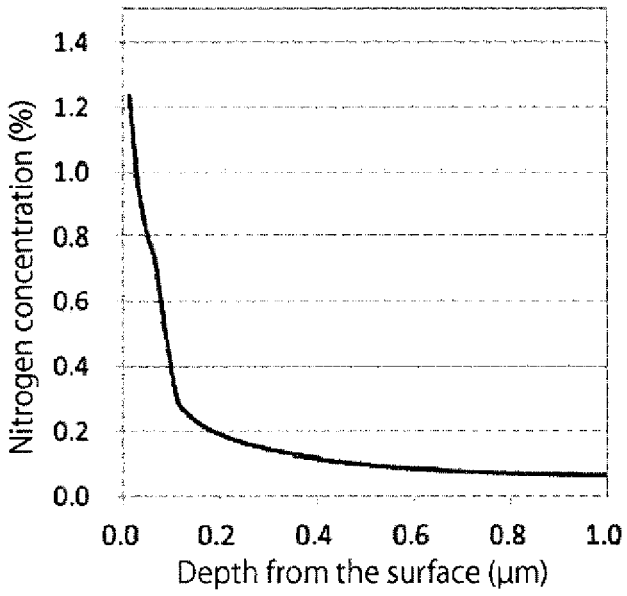
FIG. 1 is a graph illustrating an example of a concentration distribution of nitrogen from a surface of a steel sheet in a sheet thickness depth direction.

The present inventors conducted detailed studies about a ferritic stainless steel sheet that can prevent or reduce initial corrosion and obtained the following findings (a) to (d).

(a) The initial corrosion is corrosion that is formed on a surface, and thus surface treatments such as coating treatment axe effective. The present inventors thus paid attention to, among surface treatments, annealing nitriding treatment in which annealing is performed in a non-oxidizing atmosphere containing nitrogen gas and the like, from viewpoints of reduction in the number of processes and reduction in production costs.

(b) The present inventors considered that, by performing such annealing nitriding treatment, a nitrided layer in which nitrogen is concentrated is formed at a surface of a steel sheet, so that initial corrosion resistance can be improved. However, under some conditions for the annealing nitriding treatment and with some chemical composition of a steel, performing the nitriding treatment may rather decrease initial corrosion resistance and additionally result in poor material quality. This is attributable to occurrence of sensitization or formation of a martensite phase.

(c) The present inventors thus paid attention to the fact that adjusting a chemical composition and controlling conditions for the nitriding treatment appropriately are effective for improving initial corrosion resistance. Preferable conditions for the nitriding treatment include preparing a non-oxidizing atmosphere including 80 to 99% of nitrogen gas with the balance consisting of hydrogen gas and performing annealing within the temperature range of 850 to 1000° C.

(d) By setting an average nitrogen concentration from a surface of a steel sheet to a 0.05 μm position in a sheet thickness direction, that is, in a vicinity of the surface of the steel sheet, at 0.80% or more under the conditions, a ferritic stainless steel sheet having a good initial corrosion resistance is obtained. Further, in a case where the average nitrogen concentration is 1.0% or more, a ferritic stainless steel sheet having a better initial corrosion resistance can be obtained.

The present invention is made based on the findings described above. Requirements of the present invention will be described below in detail.

1. Configuration of Ferritic Stainless Steel Sheet According to the Present Invention A ferritic stainless steel sheet according to the present invention includes a base metal and a nitrided layer that is formed on a surface of the base metal.

2. Chemical Composition of Base Metal

Reasons for limiting a content of each element in a chemical composition of the base metal are as follows. In the following description, the symbol "%" for each content means "mass %".

C: 0.001 to 0.020%

C (carbon) degrades toughness, corrosion resistance (initial corrosion resistance), and oxidation resistance, and thus the content of C is preferably minimized. The content of C is therefore set at 0.020% or less, preferably 0.010% or less. However, excessive reduction of C leads to an increase in refining costs. The content of C is therefore set at 0.001% or more. With consideration given to production costs and corrosion resistance, the content of C is preferably 0.002% or more, and more preferably 0.005% or more.

Si: 0.01 to 1.50%

Si (silicon) is a deoxidizing element as well as an element that improves corrosion resistance (initial corrosion resistance), oxidation resistance, and high temperature strength. The content of Si is therefore set at 0.01% or more. Note that to obtain an advantageous effect of improving the corrosion resistance significantly, the content of Si is preferably 0.15% or more, more preferably more than 0.30%, and still more preferably 0.80% or more.

On the other hand, containing Si at more than 1.50% makes the steel sheet significantly hard, decreasing a bendability of a resultant pipe when the pipe is worked. The content of Si is therefore set at 1.50% or less. With consideration given to toughness and pickling properties in production of the steel sheet, the content of Si is preferably 1.20% or less. The content of Si is more preferably 1.00% or less.

Mn: 0.01 to 1.50%

Mn (manganese) forms $MnCr_2O_4$ or MnO at high temperature, improving scale adhesion. The content of Mn is therefore set at 0.01% or more. The content of Mn is preferably 0.15% or more, and more preferably 0.20% or more. However, if Mn is contained at more than 1.50%, corrosion resistance, particularly initial corrosion resistance decreases, and additionally, an amount of oxides is increased, which tends to bring about unusual oxidation. The content of Mn is therefore set at 1.50% or less. Further, with consideration given to the toughness and the pickling properties in production of the steel sheet, the content of Mn is preferably 1.00% or less, and more preferably 0.70% or less. Moreover, in a case where flat cracking attributable to oxides in a weld zone is taken into consideration, the content of Mn is more preferably 0.30% or less.

P: 0.010 to 0.050%

As with Si, P (phosphorus) is a solid-solution strengthening element, and thus the content of P is preferably reduced from viewpoints of material quality and toughness. The content of P is therefore set at 0.050% or less. However, excessive reduction of P leads to an increase in refining costs. The content of P is therefore set at 0.010% or more. With consideration given to production costs and oxidation resistance, the content of P is preferably 0.015% or more, and more preferably 0.030% or less.

S: 0.0001 to 0.010%

S (sulfur) is preferably minimized from viewpoints of material quality, corrosion resistance (initial corrosion resistance), and oxidation resistance. In particular, if S is contained to excess, S produces its compounds with Ti or Mn, causing a crack from inclusions serving as its origin when a resultant pipe is bent. The content of S is therefore set at 0.010% or less. However, excessive reduction of S leads to an increase in refining costs. The content of S is therefore set at 0.0001% or more. Further, with consideration given to production costs and corrosion resistance, the content of S is preferably 0.0005% or more, and more preferably 0.0050% or less.

Cr: 16.0 to 25.0%

Cr (chromium) is an element that improves corrosion resistance (initial corrosion resistance) and oxidation resistance. To obtain a sufficient corrosion resistance for preventing initial corrosion, the content of Cr is set at 16.0% or more. The content of Cr is preferably 16.5% or more, and more preferably 17.0% or more. However, if the content of Cr is more than 25.0%, toughness decreases, and producibility also decreases. The content of Cr is therefore set at 25.0% or less. The content of Cr is preferably 23.0% or less. From a viewpoint of production costs, the content of Cr is more preferably less than 22.0%. Further, from a viewpoint of a toughness of a hot-rolled sheet in production of the steel sheet, the content of Cr is preferably 18.0% or less.

N: 0.001 to 0.030%

As with C, N (nitrogen) decreases low-temperature toughness and workability and additionally decreases corrosion resistance (initial corrosion resistance) when combining with Cr to form a nitride of Cr. It is therefore preferable to minimize a content of N in the parent phase of the steel sheet. The content of N is therefore set at 0.030% or less. The content of N is preferably 0.020% or less. On the other hand, excessive reduction of N leads to an increase in refining costs. The content of N is therefore set at 0.001% or more. With consideration given to production costs and toughness, the content of N is preferably 0.005% or more, and more preferably 0.008% or more.

Ti: 0.01 to 0.30%

Ti (titanium) has an effect of improving corrosion resistance (initial corrosion resistance), intergranular corrosion resistance, and deep drawability by combining with C, N, and S. Further, Ti nitrides increase an equiaxed crystal ratio by serving as nuclei of grains in slab casting. As a result, a coarse steel microstructure derived from columnar crystals, which causes surface unevenness, is eliminated, and a surface quality is improved.

Such an effect of immobilizing C, N, and S by combining with these elements is exerted when the content of Ti is 0.01% or more. The content of Ti is therefore set at 0.01% or more, and preferably 0.11% or more. However, if Ti is contained at more than 0.30%, dissolved Ti makes the steel sheet hard, and additionally, toughness is decreased. The content of Ti is therefore set at 0.30% or less. With consideration given to production costs and the like, the content of Ti is preferably 0.05% or more, and preferably 0.25% or less.

In the present invention, it is preferable to contain, in addition to the chemical composition described above, one or more groups selected from components of the following group A, group B, and group C as necessary. Note that elements classified as a group A are elements that improve corrosion resistance, elements classified as a group B are elements that improve high temperature properties such as high temperature strength, and elements classified as a group C are elements that influence toughness or surface texture.

<Group A Elements>

Nb: 0 to 0.80%

As with Ti, Nb (niobium) has an effect of improving corrosion resistance (initial corrosion resistance), intergranular corrosion resistance, and deep drawability by combining with C, N, and S. Further, Nb is high in solid-solution strengthening ability at a high temperature range and precipitation strengthening ability and also has an effect of improving high temperature strength and thermal fatigue properties. Therefore, it may be contained as necessary.

However, if Nb is contained to excess, toughness in a steel sheet producing stage is significantly decreased. In addition, coarse carbo-nitrides or coarse intermetallic compounds called Laves phase during annealing are caused to precipitate. Such precipitates pin grain boundaries to deter recrystallization. As a result, there is a possibility that unrecrystallized structures remain in the steel, degrading surface quality. The content of Nb is therefore set at 0.80% or less. The content of Nb is preferably 0.55% or less. On the other hand, to obtain the effects, the content of Nb is preferably 0.10% or more. With consideration given to intergranular corrosiveness of a weld zone, production costs, and producibility, the content of Nb is preferably 0.15% or more, and more preferably 0.30% or less.

Here, a total content of Ti and Nb preferably satisfies Formula (i) below. This is because if the total content of Ti and Nb is less than 3(C+N), C and N cannot be fixed sufficiently, and a surplus of C and N may be dissolved in the steel to make the steel hard, decreasing workability.

$$Nb+Ti \geq 3(C+N) \quad (i)$$

where symbols of elements in Formula (i) above indicate contents (mass %) of the elements contained in the steel, and when an element is not contained, zero will be set to the corresponding symbol.

Note that to obtain the effect of increasing the equiaxed crystal ratio in a cast steel microstructure so as to eliminate the coarse steel microstructure derived from columnar crystals, the left side value of Formula (i) above is preferably 0.10 or more, and more preferably 0.15 or more. Further, from a viewpoint of making the material hard and production costs, the left side value of Formula (i) above is preferably 1.0 or less.

Sn: 0 to 0.50%

Sn (tin) has an effect of improving corrosion resistance (initial corrosion resistance) and high temperature strength. Therefore, it may be contained as necessary. However, if the content of Sn is more than 0.50%, slab cracking occurs in production of the steel sheet, and a toughness of a resultant muffler hanger is decreased. The content of Sn is therefore set at 0.50% or less. On the other hand, to obtain the effects, the content of Sn is preferably 0.01% or more. With consideration given to refining costs and producibility, the content of Sn is preferably 0.05% or more, and preferably 0.15% or less.

Al: 0 to 3.0%

Al (aluminum) is an element having a deoxidation effect. Further, Al has an effect of improving corrosion resistance as well as high temperature strength and oxidation resistance. In addition, Al serves as precipitation sites of TiN and a Laves phase, contributing to fine precipitation of the precipitates and improving low temperature toughness. Therefore, it may be contained as necessary.

However, if Al is contained at more than 3.0%, elongation is decreased, leading to a decrease in weldability and surface quality. Moreover, coarse Al oxide is formed, decreasing low temperature toughness. The content of Al is therefore set at 3.0% or less. On the other hand, to obtain the effects, the content of Al is preferably 0.003% or more. With consideration given to refining costs, the content of Al is preferably 0.01% or more, and preferably 1.0% or less.

Ni: 0 to 2.0%

Ni (nickel) is an element that improves toughness and corrosion resistance (initial corrosion resistance) and therefore may be contained as necessary. However, if Ni is contained at more than 2.0%, an austenite phase is produced, decreasing formability and additionally decreasing pipe bendability significantly. The content of Ni is therefore set at 2.0% or less. With consideration given to production costs, the content of Ni is preferably 0.5% or less. On the other hand, the advantageous effect of improving toughness by Ni is exerted when the content of Ni is 0.1% or more, and thus the content of Ni is preferably 0.1% or more.

V: 0 to 1.0%

V (vanadium) has an effect of improving corrosion resistance (initial corrosion resistance) and heat resistance by combining with C or N. Therefore, it may be contained as necessary. However, if V is contained at more than 1.0%, coarse carbo-nitrides are formed, decreasing toughness. The content of V is therefore set at 1.0% or less. With consideration given to production costs and producibility, the content of V is preferably 0.2% or less. On the other hand, the content of V is preferably 0.05% or more to obtain the effect.

Cu: 0 to 2.0%

Cu (copper) has an effect of improving corrosion resistance (initial corrosion resistance) and an effect of improving high temperature strength in an intermediate temperature range by precipitation of Cu dissolved in the parent phase, what is called ε-Cu. Therefore, it may be contained as necessary. However, containing Cu excessively leads to a decrease in toughness due to making the steel sheet hard and a decrease in ductility. The content of Cu is therefore set at 2.0% or less. On the other hand, to obtain the effect described above, the content of Cu is to be preferably 0.1% or more, and more preferably 1.0% or more. With consideration given to oxidation resistance and producibility, the content of Cu is preferably less than 1.5%, and more preferably 1.4% or less.

Mo: 0 to 3.0%

Mo (molybdenum) is an element that improves corrosion resistance (initial corrosion resistance) and an element that prevents or reduces crevice corrosion particularly in a tube blank and the like having a crevice structure. Therefore, it may be contained as necessary. However, if the content of Mo is more than 3.0%, formability deteriorates significantly, and producibility is decreased. The content of Mo is therefore set at 3.0% or less. On the other hand, to obtain the effects, the content of Mo is preferably 0.10% or more. With consideration given to alloy costs and productivity, the content of Mo is preferably 0.15% or more, and preferably 2.0% or less. The content of Mo is preferably 0.15% or more, and more preferably 0.80% or less.

Ca: 0 to 0.0030%

Ca (calcium) is an element useful as a desulfurizing element and thus may be contained as necessary. However, if the content of Ca is more than 0.0030%, coarse CaS are produced, decreasing toughness and corrosion resistance (initial corrosion resistance). The content of Ca is therefore set at 0.0030% or less. On the other hand, the content of Ca is preferably 0.0001% or more to obtain the desulfurizing effect. With consideration given to refining costs and producibility, the content of Ca is preferably 0.0003% or more, and preferably 0.0020% or less.

Ga: 0 to 0.1%

Ga (gallium) may be contained as necessary for improving corrosion resistance (initial corrosion resistance) and preventing or reducing hydrogen embrittlement. The content of Ga is set at 0.1% or less. On the other hand, to obtain the effects, the content of Ga is preferably 0.0002% or more with consideration given to production of sulfides and hydrides. From viewpoints of production costs and producibility as well as ductility and toughness, the content of Ga is preferably 0.0005% or more, and preferably 0.020% or less.

<Group B Elements>

B: 0 to 0.0050%

When segregating at grain boundaries, B (boron) has an effect of improving grain boundary strength, improving secondary workability and low temperature toughness. In addition, B has an effect of improving high temperature strength in an intermediate temperature range. Therefore, it may be contained as necessary. However, containing B at more than 0.0050% causes production of B compounds such as $Cr_2B$, degrading intergranular corrosiveness and fatigue properties. The content of B is therefore set at 0.0050% or less.

On the other hand, to obtain the effects, the content of B is preferably 0.0002% or more. With consideration given to weldability and producibility, the content of B is preferably 0.0003% or more, and preferably 0.0010% or less.

W: 0 to 3.0%

W (tungsten) has an effect of improving high temperature strength and thus may be contained as necessary. However, excessively containing W results in a deterioration in toughness and a decrease in elongation. In addition, production of a Laves phase, which is an intermetallic compound phase, is increased, inhibiting development of a texture having a {111}<112> orientation and decreasing an r value. The content of W is therefore set at 3.0% or less. With consideration given to production costs and producibility, the content of W is preferably 2.0% or less. On the other hand, the content of W is preferably 0.1% or more to obtain the advantageous effect of improving high temperature strength.

Co: 0 to 0.50%

Co (cobalt) has an effect of improving high temperature strength and thus may be contained as necessary. However, excessively containing Co decreases toughness and workability. The content of Co is therefore set at 0.50% or less. Further, with consideration given to production costs, the content of Co is preferably 0.30% or less. On the other hand, to obtain the effect, the content of Co is preferably 0.02% or more, and more preferably 0.05% or more.

Sb: 0 to 0.50%

Sb (antimony) segregates at grain boundaries to increase high temperature strength and thus may be contained as necessary. However, containing Sb at more than 0.50% causes the segregation to occur to excess, decreasing low temperature toughness of a weld zone of a resultant pipe. The content of Sb is therefore set at 0.50% or less. With consideration given to high temperature properties, production costs, and toughness, the content of Sb is preferably 0.30% or less. On the other hand, to obtain the effects, the content of Sb is preferably 0.01% or more.

<Group C Elements>

Mg: 0 to 0.0100%

Mg (magnesium) acts as a deoxidizer by forming Mg oxides in molten steel, as with Al. Further, Mg increases an equiaxed crystal ratio of a resultant slab by finely crystallized Mg oxides serving as nuclei. As a result, a coarse steel microstructure derived from columnar crystals, which causes surface unevenness, is eliminated, and a surface quality is improved. Then, precipitation of Nb-based and Ti-based fine precipitates is promoted in a subsequent process. Specifically, when the precipitates finely precipitate in a hot rolling process, the precipitates serve as recrystallization nuclei in the hot rolling process and a subsequent process of annealing the hot-rolled sheet. As a result, a very fine recrystallized structure is obtained. The recrystallized structure contributes to improvement of toughness. Therefore, it may be contained as necessary.

However, excessively containing Mg results in a deterioration in oxidation resistance, a decrease in weldability, and the like. The content of Mg is therefore set at 0.0100% or less. On the other hand, to obtain the effects, the content of Mg is preferably 0.0002% or more. With consideration given to refining costs, the content of Mg is preferably 0.0003% or more, and preferably 0.0020% or less.

Zr: 0 to 0.30%

Zr (zirconium) is an element that improves oxidation resistance and thus may be contained as necessary. However, containing Zr at more than 0.30% decreases toughness and producibility such as pickling properties significantly. Further, compounds of Zr and carbon and nitrogen are coarsened. As a result, a steel microstructure of the steel sheet is made into coarse grains in hot rolling and annealing, and the r value is decreased. The content of Zr is therefore set at 0.30% or less. With consideration given to production costs, the content of Zr is preferably 0.20% or less. On the other hand, the content of Zr is preferably 0.05% or more to obtain the effect.

Ta: 0 to 0.10%

Ta (tantalum) contributes to improvement in toughness by combining with C and N and thus may be contained as necessary. However, if the content of Ta is more than 0.10%, production costs are increased, and additionally, producibility is decreased significantly. The content of Ta is therefore set at 0.10% or less. On the other hand, to obtain the effects, the content of Ta is preferably 0.01% or more. With consideration given to refining costs and producibility, the content of Ta is preferably 0.02% or more, and preferably 0.08% or less.

REM: 0 to 0.05%

REM (rare earth metal) refines various kinds of precipitates, improving toughness and oxidation resistance. Therefore, it may be contained as necessary. However, if the content of REM is more than 0.05%, castability is decreased significantly. The content of REM is therefore set at 0.05% or less. On the other hand, to obtain the effect, the content of REM is preferably 0.001% or more. With consideration given to refining costs and producibility, the content of REM is preferably 0.003% or more, and preferably 0.01% or less.

REM (rare earth metal) refers to 2 elements including scandium (Sc) and yttrium (Y) and 15 elements from lanthanum (La) through lutetium (Lu) (lanthanoid), 17 elements in total. The content of REM means a total content of these elements, and the elements may be added individually or in a form of a mixture.

In the chemical composition according to the present invention, the balance consists of Fe and unavoidable impurities. The term "unavoidable impurities" as used herein means components that are mixed in steel in producing the steel industrially due to raw materials such as ores and scraps, and various factors in a producing process, and are allowed to be mixed in the steel within their respective ranges in which the unavoidable impurities have no adverse effect on the present invention.

3. Steel Microstructure

It is desirable that a steel microstructure of the base metal of the ferritic stainless steel sheet be substantially a ferritic single phase. Specifically, the steel microstructure of the base metal preferably includes, in volume ratio, 95% or more of a ferritic phase. Note that, for example, a hard phase unavoidably produced, such as a martensite phase, can be contained at 5% or less. Volume ratios of the ferritic phase and the hard phase are to be measured by a ferrite meter, steel microstructure observation, and the like.

4. Nitrided Layer

The nitrided layer is a layer in which nitrogen is concentrated and that is formed by annealing nitriding treatment. In the ferritic stainless steel sheet according to the present invention, the nitrided layer refers to a layer that is present in a region from a surface of a rolled surface to a 0.05 μM depth position in a sheet thickness direction, where the concentration of nitrogen occurs significantly. For the ferritic stainless steel sheet according to the present invention, an average nitrogen concentration in the nitrided layer is set at, in mass %, 0.80% or more. The average nitrogen concentration in the nitrided layer is preferably 1.0% or more.

The average nitrogen concentration is obtained by measuring a nitrogen distribution in the sheet thickness direction by sputtering up to 1 μm from the surface in the glow discharge optical emission spectrometry (GDS) and calculating an average concentration from the surface of the steel sheet to a 0.05 μm position.

Here, the average nitrogen concentration in the nitrided layer and initial corrosion resistance will be described. A JASO mode combined cyclic corrosion test simulating an open-air corrosive environment (the cyclic corrosion test defined in JASO-M609-92) was conducted to evaluate nitrogen concentrations in nitrided layers and initial corrosion resistances.

Specifically, specimens that were subjected to nitriding treatment and had different average nitrogen concentrations in their nitrided layers were prepared. The average nitrogen concentration was measured by the method described above. The distribution of nitrogen concentration from a surface of the steel sheet in its sheet thickness direction is, for example, as illustrated in FIG. 1. As seen from FIG. 1, the nitrogen concentration has a tendency to be highest at the surface and gradually decrease as a depth in the sheet thickness direction increases.

As a method for evaluating initial corrosion, pitting that occurred on a surface of the sample subjected to the cyclic corrosion test was taken as a portion for evaluation. Specifically, a test specimen was cut into 70 mm×40 mm, and its end portion was sealed by 5 mm and used as a sample. The cyclic corrosion test was conducted until pitting occurred under test conditions including: spraying with a salt water (5% NaCl) at 35° C. for 2 hours, then drying at 60° C. for 4 hours, and then retaining in damp air at 50° C. and a relative humidity of 90% or more for 2 hours, which constitute a process for 8 hours in total as one cycle. The sample was placed in an apparatus in such a manner as to be inclined by 30 degrees with respect to a vertical direction.

Subsequently, the sample was taken out after every cycle, cleaned on its surface, and when pitting did not occur for five cycles or more, the sample was considered to have a sufficient corrosion resistance that prevents initial corrosion from occurring from shipment of an automobile until before its use or immediately after the use, namely initial corrosion resistance, and rated as passed.

Figure 2:
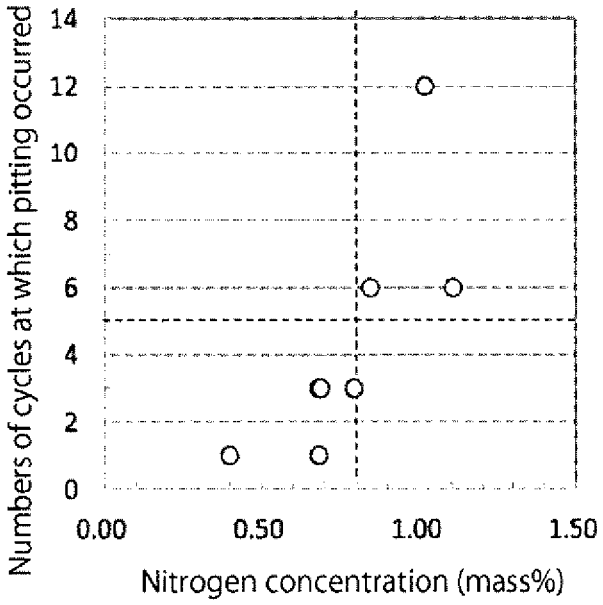
FIG. 2 is a graph illustrating a relation between average nitrogen concentrations of nitrided layers of steel sheets and numbers of cycles at which pitting occurred.

FIG. 2 is a graph illustrating a relation between average nitrogen concentrations of nitrided layers and numbers of cycles at which pitting occurred. From FIG. 2, when an average nitrogen concentration of a nitrided layer is 0.80% or more, the steel sheet that did not experience the occurrence of pitting for five cycles or more and was excellent in initial corrosion resistance was obtained.

As seen from the above, the annealing nitriding treatment is useful in improving the initial corrosion resistance. Here, N undergoes active state dissolution inside a pit of a stainless steel in an early stage of occurrence of pitting. Its dissolution product, $NH^{4+}$, blocks oxidization of the inside of the pit and promotes regeneration of a passivation film, so as to suppress occurrence and growth of pitting, improving corrosion resistance. However, in a case where nitrogen combines with Cr to form Cr nitride at grain boundaries, depletion of Cr causes sensitization, and corrosion resistance is decreased. Accordingly, by performing the annealing nitriding treatment to cause a certain amount of nitrogen to enter only a vicinity of a surface of the steel sheet, N is caused to be contained at the surface in a large amount while the formation of the nitride is prevented or reduced, so as to improve corrosion resistance.

5. Production Method

A method for producing the ferritic stainless steel sheet according to the present invention will be described. The ferritic stainless steel sheet according to the present invention provides its advantageous effects irrespective of a production method therefor as long as the ferritic stainless steel sheet has the configuration described above; nonetheless, the ferritic stainless steel sheet can be produced stably by a production method described below, for example.

5-1. Slab Casting Process

A preferable method is one in which a steel having the chemical composition described above is melted in a converter and subsequently subjected to secondary refining. Subsequently, the molten steel is preferably made into a slab according to a known casting method (continuous casting). Note that conditions for the casting are to conform to conditions for conventional continuous casting method.

5-2. Hot Rolling Process

Subsequently, the produced slab is preferably subjected to hot rolling by continuous rolling so as to have a predetermined sheet thickness. Here, if a heating temperature of the slab in the hot rolling is less than 1100° C., alloying elements are not fully dissolved, and precipitates are produced, which may have an adverse effect in the following processes. On the other hand, if the heating temperature of the slab is more than 1250° C., slab sagging may occur, in which the slab undergoes high temperature deformation under its own weight. It is therefore preferable to set the heating temperature of the slab in the hot rolling at 1100 to 1250° C. Further, with consideration given to productivity and occurrence of surface defect, the heating temperature of the slab is more preferably 1150 to 1200° C. Note that, in the present invention, the heating temperature of the slab is synonymous with a hot rolling start temperature.

In the hot rolling process, it is preferable to subject the heated slab to rough rolling with a plurality of passes and subsequently subject the slab to finish rolling through a plurality of stands in one direction. The slab is thereby formed into a hot-rolled sheet and coiled into a coil. An end temperature of the finish rolling is preferably 950 to 1150° C., and a coiling temperature is preferably within the range of 600° C. or less for avoiding a decrease in toughness during the coiling due to production of precipitates.

5-3. Hot-Rolled Sheet Pickling Process

For the ferritic stainless steel sheet according to the present invention, it is preferable to subject the hot-rolled steel sheet to pickling treatment, without performing hot-rolled sheet annealing on the hot-rolled steel sheet, into a starting material for cold rolling in a cold rolling process. This is different from a normal production method usually employed, in which hot-rolled sheet annealing is performed on a hot-rolled steel sheet to give size-regulated, recrystallized structure. Note that the hot-rolled sheet annealing may be performed in a case where, for example, the hot-rolled steel sheet is hard and need to be softened.

5-4. Cold Rolling Process

In a cold rolling process, a rolling reduction is preferably 50% or more, and more preferably 60% or more. A reason for setting the rolling reduction within the range is that increasing the rolling reduction increases stored energy, which serves as driving force for recrystallization, so that the recrystallization can be completed in a temperature range for annealing nitriding treatment described later.

5-5. Annealing and Nitriding Treatment Process after Cold Rolling

In annealing after the cold rolling, a steel sheet in which nitrogen is concentrated at its surface can be provided by performing the annealing in a non-oxidizing atmosphere including nitrogen gas with the balance consisting of hydrogen gas (hereafter, simply referred to as "annealing nitriding treatment"). Although nitriding treatment is performed generally as a separated process after annealing a steel sheet, performing nitriding treatment concurrently with annealing a cold-rolled steel sheet enables combination of cost reduction by omitting a process and improvement in corrosion resistance. For this reason, annealing and nitriding treatment are desirably performed in a single process.

Here, a nitrided layer formed on a surface of the steel sheet is formed mainly by disappearance of a fine passivation film consisting of Cr oxides through reduction by hydrogen in the atmosphere and entrance of nitrogen therefrom under a high-temperature atmosphere.

At this time, if nitrogen runs short, the nitriding does not occur sufficiently, and if nitrogen is in excess, the reduction by hydrogen does not occur. For this reason, a concentration of nitriding gas is preferably within the range of 80 to 99%. The concentration is more preferably within the range of 90 to 98%.

If an annealing nitriding treatment temperature is excessively low, the entrance of nitrogen does not occur, failing to secure a sufficient amount of nitrogen, and additionally a problem that an unrecrystallized structure remains arises. For this reason the treatment temperature is preferably 850° C. or more. On the other hand, if the treatment temperature is excessively high, nitrogen may enter to excess. In addition, martensite may be produced in a later process. For this reason, the treatment temperature is preferably 1000° C. or less. The treatment temperature is more preferably within the range of 880 to 980° C.

Likewise, if a treatment duration is short, the entrance of nitrogen does not occur, failing to secure a sufficient amount of nitrogen, and additionally a problem that an unrecrystallized structure remains arises. For this reason, the treatment duration is preferably 30 seconds or more. On the other hand, the longer the treatment duration is, the more an amount of nitrogen entering the surface of the steel sheet increases, but if the treatment duration is excessively long, the entrance of nitrogen also occurs to excess. As a result, sensitization occurs due to formation of nitrides at grain boundaries, and a martensite phase is formed due to phase transformation, resulting in deterioration in corrosion resistance and material quality. For this reason, the treatment duration is preferably 300 seconds or less. The treatment duration is more preferably within the range of 50 to 200 seconds.

To further improve ductility, it is preferable to control a cooling rate after retention at the treatment temperature. If the cooling rate is less than 5° C./s, nitrides are produced during the cooling to bring about sensitization, decreasing corrosion resistance. Further, nitrogen may enter to excess, and martensite may be produced. Moreover, if precipitates are formed to excess to bring about precipitation strengthening, ductility is decreased. For this reason, the cooling rate is preferably 5° C./s or more. On the other hand, if the cooling rate is more than 100° C./s, martensite may be produced to make the steel sheet hard, decreasing ductility. For this reason, the cooling rate is preferably 100° C./s or less. The cooling rate is more preferably within the range of 10 to 80° C./s, and more preferably within the range of 15 to 50° C./s. Note that a cooling stop temperature is preferably within the range of 300 to 500° C.

5-6. Pickling Process after Annealing Nitriding Treatment

In a case where scales are formed on the steel sheet after the annealing nitriding treatment, the steel sheet is to be pickled as necessary. However, excessive pickling is not desirable because the nitrided layer formed in the process described above is dissolved. Therefore, for the ferritic stainless steel sheet according to the present invention, in a case where pickling is to be performed because scales are formed by performing the annealing nitriding treatment in the non-oxidizing atmosphere, it is necessary to select a pickling condition under which the nitrided layer is not dissolved. Note that a solution and a method for the pickling are not limited to particular solution and method; however, electrolytic pickling is preferably performed.

5-7. Other Conditions for Production

Other conditions for the production are to be selected as appropriate. For example, a slab thickness, a hot-rolled sheet thickness, and the like are to be adjusted as appropriate. In the cold rolling, a degree of roughness of rolls, rolling oil, the number of rolling passes, a rolling speed, a rolling temperature, and the like are also to be selected as appropriate. Further, a tension leveler process for straightening may be performed after the annealing, and strip running may be performed.

Hereunder, the present invention is described more specifically by way of examples, although the present invention is not limited to these examples.

Example

Steels having chemical compositions shown in Table 1 were each melted and then cast into a slab, and the slab was heated to 1150° C., then subjected to hot rolling to have a thickness of 5 mm, and coiled at 500° C. in a form of a hot-rolled steel sheet. Note that the chemical compositions at this time are chemical compositions of their base metals.

TABLE 1

| Steel | Chemical composition of base metal (mass %, Balance: Fe and unavoidable impurities) | | | | | | | | | | | | | |
|---|---|---|---|---|---|---|---|---|---|---|---|---|---|---|
| | | | | | | | | | Group A elements | | | | | |
| No. | C | Si | Mn | P | S | Cr | N | Ti | Nb | Sn | Al | Ni | V | Cu |
| A1 | 0.018 | 0.94 | 0.42 | 0.012 | 0.0023 | 19.2 | 0.011 | 0.18 | — | — | — | — | — | — |
| A2 | 0.002 | 0.61 | 0.66 | 0.048 | 0.0048 | 20.8 | 0.013 | 0.14 | — | — | — | — | — | — |
| A3 | 0.008 | 1.45 | 0.33 | 0.027 | 0.0016 | 19.4 | 0.017 | 0.14 | — | — | — | — | — | — |
| A4 | 0.010 | 0.05 | 0.54 | 0.029 | 0.0018 | 19.2 | 0.009 | 0.17 | — | — | — | — | — | — |
| A5 | 0.009 | 0.96 | 1.43 | 0.046 | 0.0049 | 20.1 | 0.015 | 0.14 | — | — | — | — | — | — |
| A6 | 0.007 | 0.92 | 0.02 | 0.029 | 0.0016 | 18.0 | 0.012 | 0.14 | — | — | — | — | — | — |
| A7 | 0.006 | 0.58 | 0.22 | 0.042 | 0.0012 | 21.3 | 0.012 | 0.20 | 0.10 | — | — | — | — | 1.8 |
| A8 | 0.007 | 0.65 | 0.76 | 0.010 | 0.0013 | 18.0 | 0.013 | 0.17 | — | — | — | — | — | — |
| A9 | 0.006 | 0.75 | 0.99 | 0.021 | 0.0081 | 18.1 | 0.015 | 0.10 | 0.40 | — | — | — | — | — |
| A10 | 0.010 | 0.44 | 0.54 | 0.021 | 0.0004 | 18.8 | 0.013 | 0.23 | — | — | — | — | 0.9 | — |
| A11 | 0.005 | 0.42 | 0.43 | 0.041 | 0.0049 | 24.7 | 0.006 | 0.12 | 0.45 | — | — | — | 0.3 | — |
| A12 | 0.010 | 0.73 | 0.58 | 0.049 | 0.0025 | 16.1 | 0.009 | 0.14 | — | — | — | 0.4 | — | — |
| A13 | 0.008 | 0.66 | 0.82 | 0.049 | 0.0035 | 16.8 | 0.026 | 0.18 | 0.21 | — | — | — | — | — |
| A14 | 0.006 | 0.79 | 0.60 | 0.047 | 0.0028 | 19.2 | 0.002 | 0.11 | — | — | 2.6 | — | — | — |
| A15 | 0.009 | 0.28 | 0.38 | 0.031 | 0.0016 | 19.1 | 0.013 | 0.27 | — | — | — | — | — | — |
| A16 | 0.009 | 0.82 | 0.89 | 0.044 | 0.0019 | 19.7 | 0.009 | 0.02 | 0.40 | — | — | 1.8 | — | — |
| A17 | 0.006 | 0.71 | 0.42 | 0.034 | 0.0023 | 18.8 | 0.021 | 0.17 | 0.77 | — | — | — | — | — |
| A18 | 0.008 | 0.72 | 0.23 | 0.050 | 0.0042 | 19.7 | 0.012 | 0.14 | — | 0.48 | — | — | — | — |
| A19 | 0.005 | 0.12 | 0.13 | 0.033 | 0.0047 | 19.1 | 0.011 | 0.12 | — | — | — | — | — | — |
| a1 | 0.025 * | 0.92 | 0.54 | 0.027 | 0.0017 | 16.3 | 0.007 | 0.14 | — | — | — | — | — | — |
| a2 | 0.009 | 0.004 * | 0.34 | 0.015 | 0.0014 | 22.0 | 0.013 | 0.15 | — | — | — | — | — | — |
| a3 | 0.005 | 0.70 | 1.62 * | 0.013 | 0.0010 | 17.0 | 0.005 | 0.17 | — | — | — | — | — | — |
| a4 | 0.006 | 0.72 | 0.90 | 0.014 | 0.0132 * | 18.1 | 0.017 | 0.11 | 0.29 | — | — | — | — | — |
| a5 | 0.010 | 0.53 | 0.88 | 0.011 | 0.0019 | 15.1 * | 0.011 | 0.19 | — | 0.06 | — | — | — | — |
| a6 | 0.007 | 0.33 | 0.72 | 0.040 | 0.0023 | 18.7 | 0.032 * | 0.13 | 0.11 | — | — | — | — | — |
| a7 | 0.009 | 0.61 | 0.78 | 0.031 | 0.0015 | 17.9 | 0.012 | — * | — | — | — | — | — | — |

| Steel | Chemical composition of base metal (mass %, Balance: Fe and unavoidable impurities) | | | | | | | | | | | | |
|---|---|---|---|---|---|---|---|---|---|---|---|---|---|
| | Group A elements | | | Group B elements | | | | Group C elements | | | | 3 × | Nb + |
| No. | Mo | Ca | Ga | B | W | Co | Sb | Mg | Zr | Ta | REM | (C + N) | Ti |
| A1 | — | — | — | — | — | — | — | — | — | — | — | 0.09 | 0.18 |
| A2 | — | — | — | — | — | — | 0.46 | — | — | — | — | 0.05 | 0.14 |
| A3 | — | — | 0.09 | — | — | — | — | — | — | — | — | 0.08 | 0.14 |
| A4 | — | — | — | — | — | — | — | 0.009 | — | — | — | 0.06 | 0.17 |
| A5 | — | — | — | — | — | — | — | — | — | — | — | 0.07 | 0.14 |
| A6 | — | — | — | — | — | — | — | — | — | — | — | 0.06 | 0.14 |
| A7 | — | — | — | — | — | — | — | — | — | — | — | 0.05 | 0.30 |
| A8 | — | — | — | — | — | — | — | — | — | — | — | 0.06 | 0.17 |
| A9 | — | 0.0022 | — | — | — | — | — | — | — | — | — | 0.06 | 0.50 |

TABLE 1-continued

| | | | | | | | | | | | | | |
|---|---|---|---|---|---|---|---|---|---|---|---|---|---|
| A10 | — | — | — | — | — | — | — | — | — | — | — | 0.07 | 0.23 |
| A11 | 2.70 | — | — | 0.0031 | — | — | — | — | — | — | — | 0.03 | 0.57 |
| A12 | — | — | — | — | — | — | — | — | — | — | — | 0.06 | 0.14 |
| A13 | — | — | — | — | — | — | — | — | — | — | — | 0.10 | 0.39 |
| A14 | — | — | — | — | — | 0.44 | — | — | 0.25 | — | — | 0.02 | 0.11 |
| A15 | — | — | — | — | — | — | — | — | — | — | — | 0.07 | 0.27 |
| A16 | — | — | — | — | 2.7 | — | — | — | — | — | 0.04 | 0.05 | 0.42 |
| A17 | — | — | — | — | — | — | — | — | — | — | — | 0.08 | 0.94 |
| A18 | — | — | — | — | — | — | — | — | — | 0.08 | — | 0.08 | 0.14 |
| A19 | — | — | — | — | — | — | — | — | — | — | — | 0.05 | 0.12 |
| a1 | — | — | — | — | — | — | — | — | — | — | — | 0.10 | 0.14 |
| a2 | — | — | — | — | — | — | — | — | — | — | — | 0.07 | G.15 |
| a3 | — | — | — | — | — | — | — | — | — | — | — | 0.03 | 0.17 |
| a4 | — | — | — | — | — | — | — | — | — | — | — | 0.07 | 0.40 |
| a5 | — | — | — | — | — | — | — | — | — | — | — | 0.06 | 0.19 |
| a6 | — | — | — | — | — | — | — | — | — | — | — | 0.12 | 0.24 |
| a7 | — | — | — | — | — | — | — | — | — | — | — | 0.06 | — |

The mark "*" indicates that a value with the mark is out of a range of the corresponding element defined in the present invention.

The hot-rolled steel sheet pickled is then subjected to cold rolling at a rolling reduction of 60% with rolls having a diameter of 500 mm and subjected to annealing nitriding treatment by performing continuous annealing at temperatures, in atmospheres, and durations shown in Table 2. Note that a cooling rate in the annealing nitriding treatment is 20° C./s, and the cooling was performed down to 350° C. The annealed sheets thus obtained were each subjected to electrolytic pickling with 10% sulfuric acid aqueous solution at 60° C. at a current density of 60 A/Dm$^2$ for 10 seconds, into a test specimen.

The resulting test specimen was thereafter measured in terms of a volume ratio of its ferritic phase and an average nitrogen concentration in its nitrided layer and then evaluated in terms of corrosion resistance, particularly initial corrosion resistance. In addition, a JIS No. 13B test coupon was cut out from the test specimen and subjected to a tensile test. Here, elongations at break of examples shown in Table 2 were all 20% or more, and the examples were considered to have no problem in material quality.

<Measurement of Ferritic Phase>

A volume ratio of a ferritic phase was measured with a ferrite meter. At this time, in a case where the volume ratio did not satisfy the range of the volume ratio of a ferritic phase defined in the present invention, and 5% or more of a martensite phase, which is a phase other than ferrite, was produced, "Observed" was written in an item of observation of a martensite phase in Table 2.

<Measurement of Average Nitrogen Concentration in Nitrided Layer>

As an average nitrogen concentration of the nitrided layer, an average nitrogen concentration at a surface portion of the steel sheet was measured for a nitrogen distribution in the sheet thickness direction by sputtering up to 1 μm from the surface of a rolled surface in the glow discharge optical emission spectrometry (GDS), and an average concentration from the surface of the steel sheet to a 0.05 μm position was calculated as the average nitrogen concentration in the nitrided layer. Note that measurement conditions for the GSD were determined as follows. Internal diameter of anode: 13 mm, analysis mode: high frequency mode, discharge power: 30 W, control pressure: 3.5 hPa, and detect wavelength: 110 to 800 nm.

<Evaluation of Initial Corrosion Resistance>

For evaluating corrosion resistance, a JASO mode combined cyclic corrosion test simulating an open-air corrosive environment (the cyclic corrosion test defined in JASO-M609-92) was conducted to evaluate initial corrosion resistances.

A specific method for calculating corrosion resistance will be described below. The resulting test specimens were cut into 70 mm×40 mm, and their end portions were sealed by 5 mm and used as samples. The cyclic corrosion test was conducted until pitting occurred under test conditions including: spraying with a salt water (5% NaCl) at 35° C. for 2 hours, then drying at 60° C. for 4 hours, and then retaining in damp air at 50° C. and a relative humidity of 90% or more for 2 hours, which constitute a process for 8 hours in total as one cycle. The samples were each placed in an apparatus in such a manner as to be inclined by 30 degrees with respect to a vertical direction.

Pitting that occurred on a surface of the sample subjected to the cyclic corrosion test was taken as a portion for evaluating initial corrosion. Specifically, the sample was taken out after every cycle, cleaned on its surface, and when pitting did not occur for five cycles or more, the sample was considered to have a sufficient corrosion resistance that prevents initial corrosion from occurring from shipment of an automobile until before its use or immediately after the use (initial corrosion resistance), and (○) was written. If pitting occurred within the five cycles, the number of cycles after which the pitting occurred was written in Table 2. The test was conducted up to seven cycles, and a sample in which pitting was not observed even after the seven cycles was considered to be particularly excellent (⊙).

TABLE 2

| | | | Conditions for annealing nitriding treatment of cold-rolled sheet | | | Steel | Average nitrogen | Property |
|---|---|---|---|---|---|---|---|---|
| | Symbol | Steel No. | Nitrogen gas concentration (%) | Treatment temperature (° C.) | Treatment duration (s) | microstructure Martensite phase | concentration in nitrided layer (%) | Initial corrosion resistance |
| Inventive example | B1 | A1 | 98 | 950 | 100 | — | 0.95 | ○ |
| | B2 | A2 | 95 | 900 | 100 | — | 0.83 | ○ |

TABLE 2-continued

| | Symbol | Steel No. | Conditions for annealing nitriding treatment of cold-rolled sheet: Nitrogen gas concentration (%) | Treatment temperature (° C.) | Treatment duration (s) | Steel microstructure Martensite phase | Average nitrogen concentration in nitrided layer (%) | Property Initial corrosion resistance |
|---|---|---|---|---|---|---|---|---|
| | B3 | A3 | 98 | 900 | 100 | — | 0.86 | ○ |
| | B4 | A4 | 98 | 900 | 100 | — | 0.92 | ○ |
| | B5 | A5 | 98 | 850 | 100 | — | 0.81 | ○ |
| | B6 | A6 | 98 | 950 | 100 | — | 0.93 | ○ |
| | B7 | A7 | 95 | 850 | 100 | — | 0.84 | ○ |
| | B8 | A8 | 98 | 950 | 100 | — | 0.95 | ○ |
| | B9 | A9 | 90 | 980 | 300 | — | 1.22 | ◎ |
| | B10 | A10 | 98 | 950 | 100 | — | 0.92 | ○ |
| | B11 | A11 | 90 | 950 | 300 | — | 1.31 | ◎ |
| | B12 | A12 | 95 | 950 | 100 | — | 0.97 | ○ |
| | B13 | A13 | 95 | 970 | 100 | — | 1.20 | ◎ |
| | B14 | A14 | 98 | 950 | 100 | — | 0.96 | ○ |
| | B15 | A15 | 99 | 950 | 100 | — | 0.93 | ○ |
| | B16 | A16 | 85 | 970 | 100 | — | 1.28 | ◎ |
| | B17 | A17 | 90 | 1000 | 200 | — | 1.51 | ◎ |
| | B18 | A18 | 95 | 950 | 100 | — | 0.98 | ○ |
| | B19 | A19 | 95 | 950 | 100 | — | 0.94 | ○ |
| Comparative example | b1 | a1 * | 90 | 950 | 100 | — | 0.95 | 1 |
| | b2 | a2 * | 95 | 900 | 100 | — | 0.87 | 3 |
| | b3 | a3 * | 95 | 900 | 100 | — | 0.85 | 3 |
| | b4 | a4 * | 97 | 900 | 100 | — | 0.81 | 1 |
| | b5 | a5 * | 95 | 900 | 100 | — | 0.84 | 1 |
| | b6 | a6 * | 98 | 900 | 100 | — | 0.80 | 2 |
| | b7 | a7 * | 95 | 900 | 100 | — | 0.82 | 1 |
| | b8 | A19 | 100 | 950 | 100 | — | 0.15 * | 1 |
| | b9 | A19 | 70 | 950 | 100 | — | 0.13 * | 1 |
| | b10 | A19 | 95 | 1050 | 100 | Observed * | 3.11 | 4 |
| | b11 | A19 | 95 | 800 | 100 | — | 0.45 * | 2 |
| | b12 | A19 | 95 | 950 | 500 | Observed * | 2.36 | 2 |
| | b13 | A19 | 95 | 950 | 10 | — | 0.21 * | 3 |

The mark "*" indicates that a value with the mark is out of a range of its corresponding element defined in the present invention.

The underline indicates that an underlined value is out of its preferable production condition or out of its targeted property in the present invention.

Symbols B1 to B19 shown in Table 2 each provided a chemical composition satisfying the ranges defined in the present invention and provided production conditions that were preferable in the present invention. Therefore, average nitrogen concentrations of their nitrided layers and their corrosion resistances, namely initial corrosion resistances, were also good. In contrast, in a case of symbols b1 to b7, the compositions of which fell out of the ranges defined in the present invention, their numbers of cycles at which pitting occurred were insufficient, and thus their corrosion resistances, namely initial corrosion resistances, were poor. Further, in a case of symbols b8 to b13, the production methods of which fell out of the preferable ranges in the present invention, the definitions according to the present invention were not satisfied such as insufficient average nitrogen concentrations of their nitrided layers or production of a martensite phase, resulting in poor initial corrosion resistances.

In addition, a steel A19 shown in Table 1 was melted and then cast into a slab, and the slab was heated to 1150° C., then subjected to hot rolling to have a thickness of 5 mm, and coiled at 500° C. in a form of a hot-rolled steel sheet.

The hot-rolled steel sheet pickled is then subjected to cold rolling at a rolling reduction of 60% with rolls having a diameter of 500 mm and subjected to annealing nitriding treatment by performing continuous annealing at temperatures, in atmospheres, durations, and cooling rates shown in Table 3. The annealed sheets thus obtained were each subjected to electrolytic pickling with 10% sulfuric acid aqueous solution at 60° C. at a current density of 60 A/Dm$^2$ for 10 seconds, into a test specimen.

The resulting test specimen was measured in terms of an average nitrogen concentration in its nitrided layer and its ferritic phase by the same procedure as shown in Table 2. For properties, initial corrosion resistance was evaluated by the same procedure as shown in Table 2. In addition, a JIS No. 13B test coupon was cut out from the test specimen and subjected to a tensile test. In the tensile test, an elongation at break of 20% or more was considered to have a sufficient elongation and rated as passed (○), and an elongation at break of less than 20% was rated as not passed (x). Results are shown in Table 3.

TABLE 3

| | Symbol | Steel No. | Conditions for annealing nitriding treatment of cold-rolled sheet: Nitrogen gas concentration (%) | Treatment temperature (° C.) | Treatment duration (sec) | Cooling rate (° C./s) | Steel microstructure Martensite phase | Average nitrogen concentration in nitrided layer (%) | Property: Initial corrosion resistance | Elongation |
|---|---|---|---|---|---|---|---|---|---|---|
| Inventive example | C1 | A19 | 98 | 950 | 100 | 10 | — | 0.96 | ○ | ○ |
| | C2 | A19 | 95 | 950 | 100 | 45 | — | 0.94 | ○ | ○ |
| Comparative example | c1 | A19 | 90 | 950 | 100 | 200 | Observed * | 0.92 | 4 | X |
| | c2 | A19 | 95 | 950 | 100 | 2 | Observed * | 2.02 | 2 | X |

The mark "*" indicates that a value with the mark is out of a range of corresponding element defined in the present invention.
The underline indicates that an underlined value is out of its preferable production condition or out of its targeted property in the present invention.

Symbols C1 and C2 each provided a chemical composition satisfying the ranges defined in the present invention, and their nitrogen gas concentrations, treatment temperatures, and treatment durations as well as cooling rates in the annealing nitriding treatment satisfied the respective preferable ranges; therefore, not only their initial corrosion resistances but also their elongations were good. In contrast, symbols c1 and c2 were poor in initial corrosion resistance and elongation because their cooling rates did not satisfy the preferable range.

The invention claimed is:

1. A ferritic stainless steel sheet comprising a base metal and a nitrided layer that is formed on a surface of the base metal, wherein a chemical composition of the base metal consists of, in mass %

C: 0.001 to 0.020%,
Si: 0.01 to 1.50%,
Mn: 0.01 to 1.50%,
P: 0.010 to 0.050%,
S: 0.0001 to 0.010%,
Cr: 16.0 to 25.0%,
N: 0.001 to 0.030%,
Ti: 0.01 to 0.30%,
Nb: 0 to 0.80%,
Sn: 0 to 0.50%,
Al: 0 to 3.0%,
Ni: 0 to 2.0%,
V: 0 to 1.0%,
Cu: 0 to 2.0%,
Mo: 0 to 3.0%,
Ca: 0 to 0.0030%,
Ga: 0 to 0.1%,
B: 0 to 0.0050%,
W: 0 to 3.0%,
Co: 0 to 0.50%,
Sb: 0 to 0.50%,
Mg: 0 to 0.0100%,
Zr: 0 to 0.30%,
Ta: 0 to 0.10%, and
REM: 0 to 0.05%, with the balance: Fe and unavoidable impurities, a steel microstructure of the base metal includes, in volume ratio, 95% or more of a ferritic phase, the nitrided layer is a layer that is present in a region from a surface of a rolled surface to a 0.05 μm depth position in a sheet thickness direction, and an average nitrogen concentration in the nitrided layer is, in mass %, 0.80% or more.

2. The ferritic stainless steel sheet according to claim 1, wherein a chemical composition of the base metal contains one or more elements selected from, in mass %:

Nb: 0.10 to 0.80%,
Sn: 0.01 to 0.50%,
Al: 0.003 to 3.0%,
Ni: 0.1 to 2.0%,
V: 0.05 to 1.0%,
Cu: 0.1 to 2.0%,
Mo: 0.10 to 3.0%,
Ca: 0.0001 to 0.0030%, and
Ga: 0.0002 to 0.1%.

3. The ferritic stainless steel sheet according to claim 2, wherein a chemical composition of the base metal contains one or more elements selected from, in mass %:

B: 0.0002 to 0.0050%,
W: 0.1 to 3.0%,
Co: 0.02 to 0.50%, and
Sb: 0.01 to 0.50%.

4. The ferritic stainless steel sheet according to claim 3, wherein a chemical composition of the base metal contains one or more elements selected from, in mass %:

Mg: 0.0002 to 0.0100%,
Zr: 0.05 to 0.30%,
Ta: 0.01 to 0.10%, and
REM: 0.001 to 0.05%.

5. The ferritic stainless steel sheet according to claim 2, wherein a chemical composition of the base metal contains one or more elements selected from, in mass %:

Mg: 0.0002 to 0.0100%,
Zr: 0.05 to 0.30%,
Ta: 0.01 to 0.10%, and
REM: 0.001 to 0.05%.

6. The ferritic stainless steel sheet according to claim 1, wherein a chemical composition of the base metal contains one or more elements selected from, in mass %:

B: 0.0002 to 0.0050%,
W: 0.1 to 3.0%,
Co: 0.02 to 0.50%, and
Sb: 0.01 to 0.50%.

7. The ferritic stainless steel sheet according to claim 6, wherein a chemical composition of the base metal contains one or more elements selected from, in mass %:

Mg: 0.0002 to 0.0100%,
Zr: 0.05 to 0.30%,
Ta: 0.01 to 0.10%, and
REM: 0.001 to 0.05%.

8. The ferritic stainless steel sheet according to claim 1, wherein a chemical composition of the base metal contains one or more elements selected from, in mass %:

Mg: 0.0002 to 0.0100%,
Zr: 0.05 to 0.30%,
Ta: 0.01 to 0.10%, and
REM: 0.001 to 0.05%.

* * * * *